US010030417B1

(12) United States Patent
Ho

(10) Patent No.: US 10,030,417 B1
(45) Date of Patent: Jul. 24, 2018

(54) INDUCTION TYPE PADLOCK

(71) Applicant: REAL LOCKS & SECURITY CO., LTD., New Taipei (TW)

(72) Inventor: Hsi-Hao Ho, New Taipei (TW)

(73) Assignee: REAL LOCKS & SECURITY CO., LTD., New Taipei (TW)

( * ) Notice: Subject to any disclaimer, the term of this patent is extended or adjusted under 35 U.S.C. 154(b) by 0 days.

(21) Appl. No.: 15/416,204

(22) Filed: Jan. 26, 2017

(51) Int. Cl.

| | |
|---|---|
| ***E05B 47/06*** | (2006.01) |
| ***E05B 17/10*** | (2006.01) |
| ***E05B 67/22*** | (2006.01) |
| ***G07C 9/00*** | (2006.01) |
| *E05B 47/00* | (2006.01) |

(52) U.S. Cl.
CPC ..... *E05B 47/0603* (2013.01); *E05B 17/10* (2013.01); *E05B 67/22* (2013.01); *G07C 9/00111* (2013.01); *E05B 2047/0058* (2013.01)

(58) Field of Classification Search
CPC ..... E05B 47/0603; E05B 17/20; E05B 67/22; E05B 2047/0058; E05B 67/02; E05B 67/24; E05B 47/0012; E05B 47/0002; E05B 37/0031; E05B 37/0034; E05B 67/06; G07C 9/00111; G07C 9/00563; Y10S 70/49; Y10T 70/8216; Y10T 70/459; Y10T 70/491; G06K 9/00013
USPC ..... 70/20, 38 A, 57.1
See application file for complete search history.

(56) References Cited

U.S. PATENT DOCUMENTS 3,993,987 A * 11/1976 Stevens ..... E05B 45/005 200/61.64
4,556,872 A * 12/1985 Masoncup ..... E05B 45/06 340/542
4,811,578 A * 3/1989 Masoncup ..... E05B 45/005 340/542
5,181,403 A * 1/1993 Lii ..... B60R 25/0221 70/209
5,194,845 A * 3/1993 Sirmon ..... B62H 5/20 200/61.64
5,404,735 A * 4/1995 Hsieh ..... E05B 45/005 70/233
5,406,257 A * 4/1995 Saito ..... B62H 5/20 340/427
5,406,812 A * 4/1995 Jaw ..... E05B 67/063 70/233
5,488,845 A * 2/1996 Hsieh ..... E05B 67/24 70/233

(Continued)

*Primary Examiner* — Suzanne L Barrett
(74) *Attorney, Agent, or Firm* — Chun-Ming Shih; HDLS IPR Services

(57) ABSTRACT

An induction type padlock includes a shell, a lock bolt, a shackle, a driving unit, a light-emitting component, and an induction control unit. The lock bolt slides in the shell and has a recess. The shackle is inserted into the shell through the lock bolt and has a latch portion being able to be latched by the lock bolt. The driving unit rotates the position limiter in the recess; the position limiter has a wide portion and a narrow portion. The induction control unit is electrically connected to the driving unit and the light-emitting component. The induction control unit senses a signal to select the wide or the narrow portion of the position limiter to be disposed in the recess and controls the light-emitting component. Therefore, the time delay problems of unlocking and locking can be solved and the distinguishable lighting indications of unlocking and locking can be obtained.

11 Claims, 6 Drawing Sheets

(56) References Cited

U.S. PATENT DOCUMENTS

| | | | | | |
|---|---|---|---|---|---|
| 5,507,160 | A * | 4/1996 | Shieh | B62H 5/18 | 70/233 |
| 5,587,702 | A * | 12/1996 | Chadfield | E05B 45/005 | 340/542 |
| 5,598,725 | A * | 2/1997 | Chang | B60R 25/0225 | 340/425.5 |
| 5,727,405 | A * | 3/1998 | Cromwell | E05B 45/005 | 340/427 |
| 5,786,759 | A * | 7/1998 | Ling | B62J 3/00 | 340/542 |
| 5,856,782 | A * | 1/1999 | Sasagawa | G08B 13/1463 | 340/571 |
| 5,920,254 | A * | 7/1999 | Hsieh | B60R 25/0225 | 307/10.2 |
| 6,047,575 | A * | 4/2000 | Larson | E05L 347/0012 | 250/231.14 |
| 7,013,686 | B1 * | 3/2006 | Chen | E05B 67/063 | 70/233 |
| 7,382,250 | B2 * | 6/2008 | Marcelle | E05L 347/0012 | 340/5.22 |
| 7,921,682 | B1 * | 4/2011 | Chang | E05B 45/005 | 340/542 |
| 7,948,359 | B2 * | 5/2011 | Marcelle | G07C 9/00182 | 340/5.64 |
| 8,225,629 | B2 * | 7/2012 | Zuraski | E05L 367/003 | 292/DIG. 37 |
| 2008/0036596 | A1 * | 2/2008 | Auerbach | E05B 39/00 | 340/542 |
| 2008/0256991 | A1 * | 10/2008 | Goldman | E05B 39/00 | 70/57.1 |

* cited by examiner

INDUCTION TYPE PADLOCK

BACKGROUND OF THE INVENTION

Field of the Invention

The present invention relates to a padlock and in particular to an induction type padlock with an unlocking method of non-contact and induction.

Description of Prior Art

Regarding the structure of the padlock, a lock bolt is disposed in the lock body of the padlock and a U-shaped shackle having a hook end is pivoted from the outside of the lock body. The hook end can be inserted into a lock hole. The user uses a key to turn the lock bolt to configure a locked state or an unlocked state between the lock bolt and the hook end.

A key is required to unlock traditional mechanical padlock. If the key is damaged or lost, a new copy of the key needs being remade or the whole lock needs replacement, which causes inconvenience to the user. Thus, an induction type padlock is developed to overcome the issues associated with the key.

The existing induction type padlock controls the transverse back-and-forth movement of the lock bolt by induction to lock or unlock the padlock. However, the existing induction type padlock uses a motor shaft to rotate a gear which is engaged with the gear threads of the lock bolt. Consequently, the motor has to drive the rotating shaft many turns such that the lock bolt can move a sufficient distance for locking or unlocking, which causes an annoying problem of a slow response to inductive locking or inductive unlocking.

In view of this, the inventor pays special attention to research with the application of related theory and tries to improve and overcome the above disadvantages regarding the above related art, which becomes the improvement target of the inventor.

SUMMARY OF THE INVENTION

The main objective of the present invention is to provide an induction type padlock, which can improve the responses to unlocking and locking to solve the time delay problems of unlocking and locking. Besides, the distinguishable lighting indications of unlocking and locking can be obtained.

To achieve the above objective, the present invention provides an induction type padlock which is used to sense a signal to be actuated. The induction type padlock comprises a shell, a lock bolt, a shackle, a driving unit, a light-emitting component, and an induction control unit. The lock bolt slides in the shell and is provided with a recess; the lock bolt is provided with at least one latch member. The shackle is inserted into the shell through the lock bolt; the shackle is provided with at least one latch portion latched by the at least one latch member correspondingly. The driving unit is disposed in the shell to rotate a position limiter disposed in the recess; the position limiter has at least one wide portion corresponding to the width of the recess and at least one narrow portion shorter than the width of the recess. The light-emitting component is disposed in the shell and emits light outward through the shell. The induction control unit is disposed in the shell and is electrically connected to the driving unit and the light-emitting component; the induction control unit senses the signal to control the driving unit to drive the position limiter to select the wide portion or the narrow portion to be disposed in the recess and controls the lighting of the light-emitting component.

Compared with the prior art, the present invention has the following effects. The responses to unlocking and locking are improved. The time delay problems of unlocking and locking are solved. The distinguishable lighting indications of unlocking and locking are obtained.

DETAILED DESCRIPTION OF THE INVENTION

Figure 1:
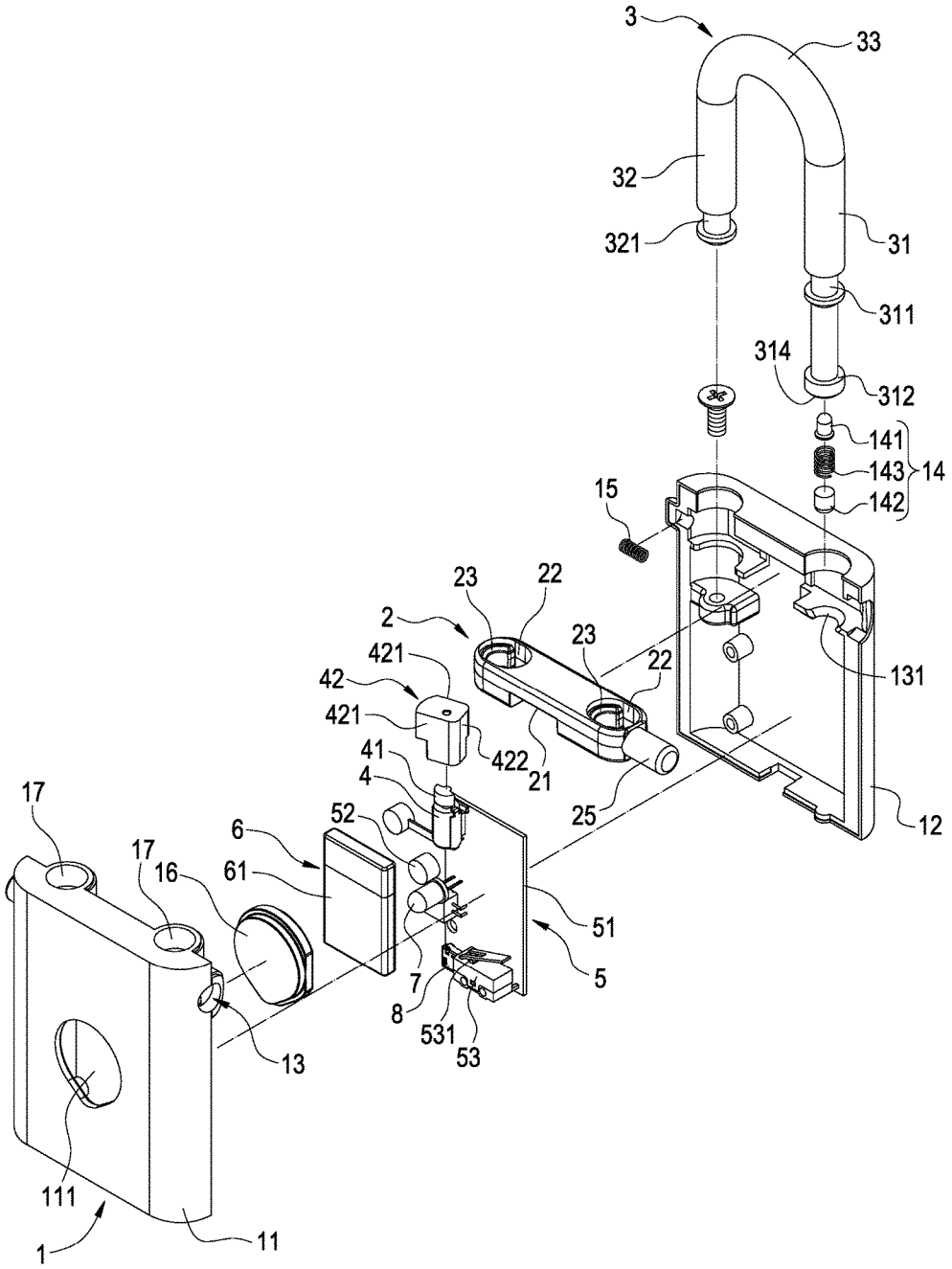
FIG. 1 is a perspective exploded view of the induction type padlock of the present invention.
Figure 2:
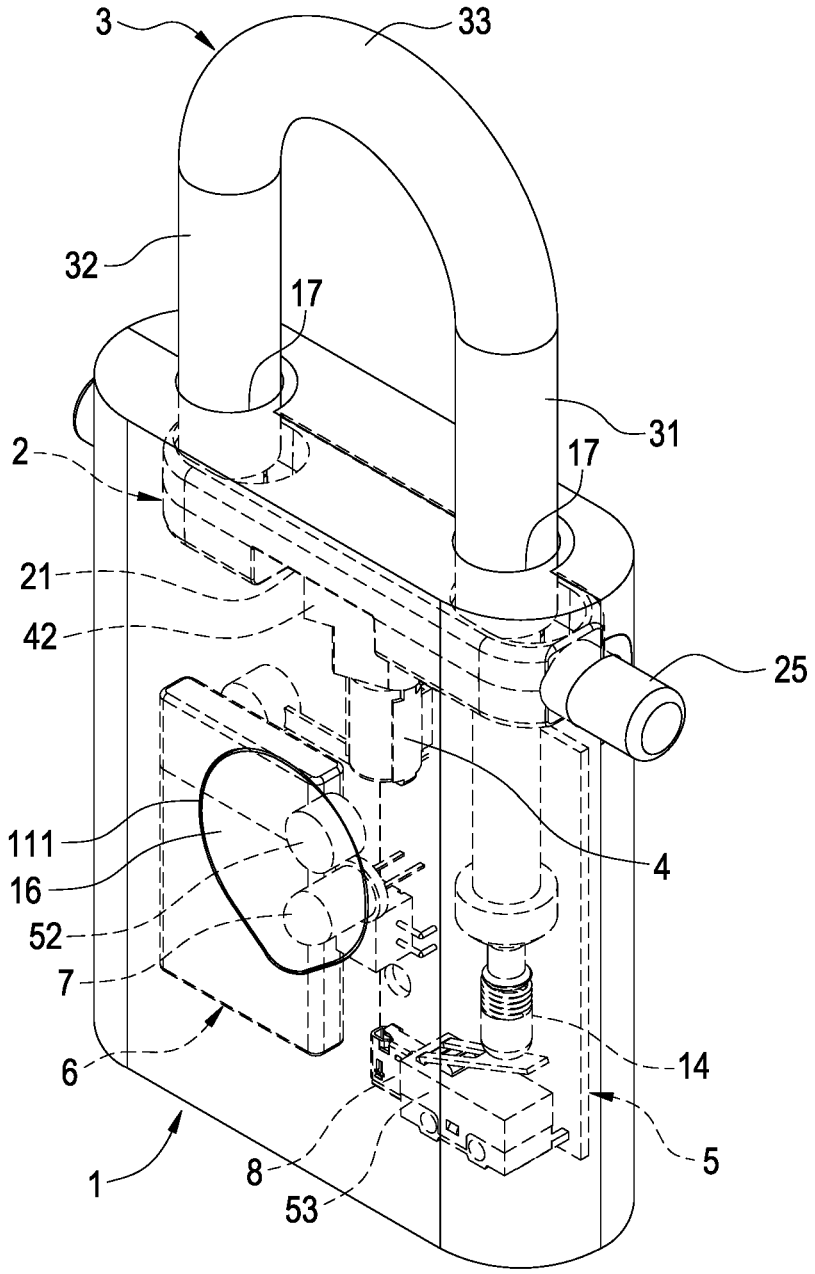
FIG. 2 is a perspective assembled view of the induction type padlock of the present invention.
Figure 3:
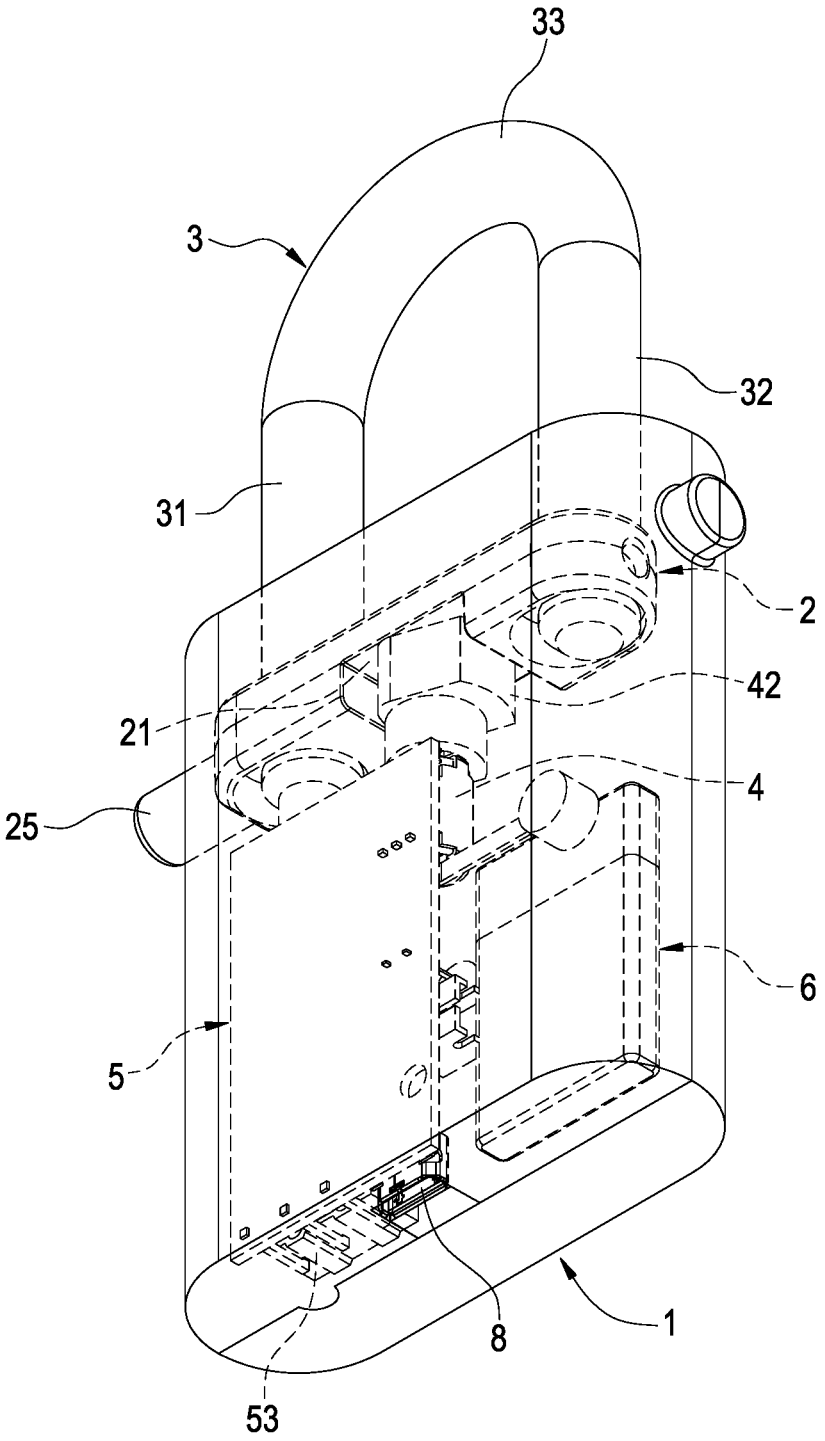
FIG. 3 is a perspective assembled view of the induction type padlock of the present invention from another view.

The detailed description and technical details of the present invention will be explained below with reference to accompanying figures. However, the accompanying figures are only for reference and explanation, but not to limit the scope of the present invention.

The present invention provides an induction type padlock, which controls the locking and unlocking according to a sense signal emitted from an electronic component (not shown). The electronic device may be any device able to emit the sense signal. The sense signal may be a signal emitted from a noncontact induction device such as a Near Field Communication (NFC) device or a Radio Frequency Identification (RFID) device. The type of the noncontact induction device is not limited in the present invention.

As shown in FIGS. 1-4, the induction type padlock of the present invention comprises a shell 1, a lock bolt 2, a shackle 3, a driving unit 4, an induction control unit 5, and a light-emitting component 7. Preferably, the induction type padlock further comprises a power supply 6 and a USB connector 8.

Figure 4:
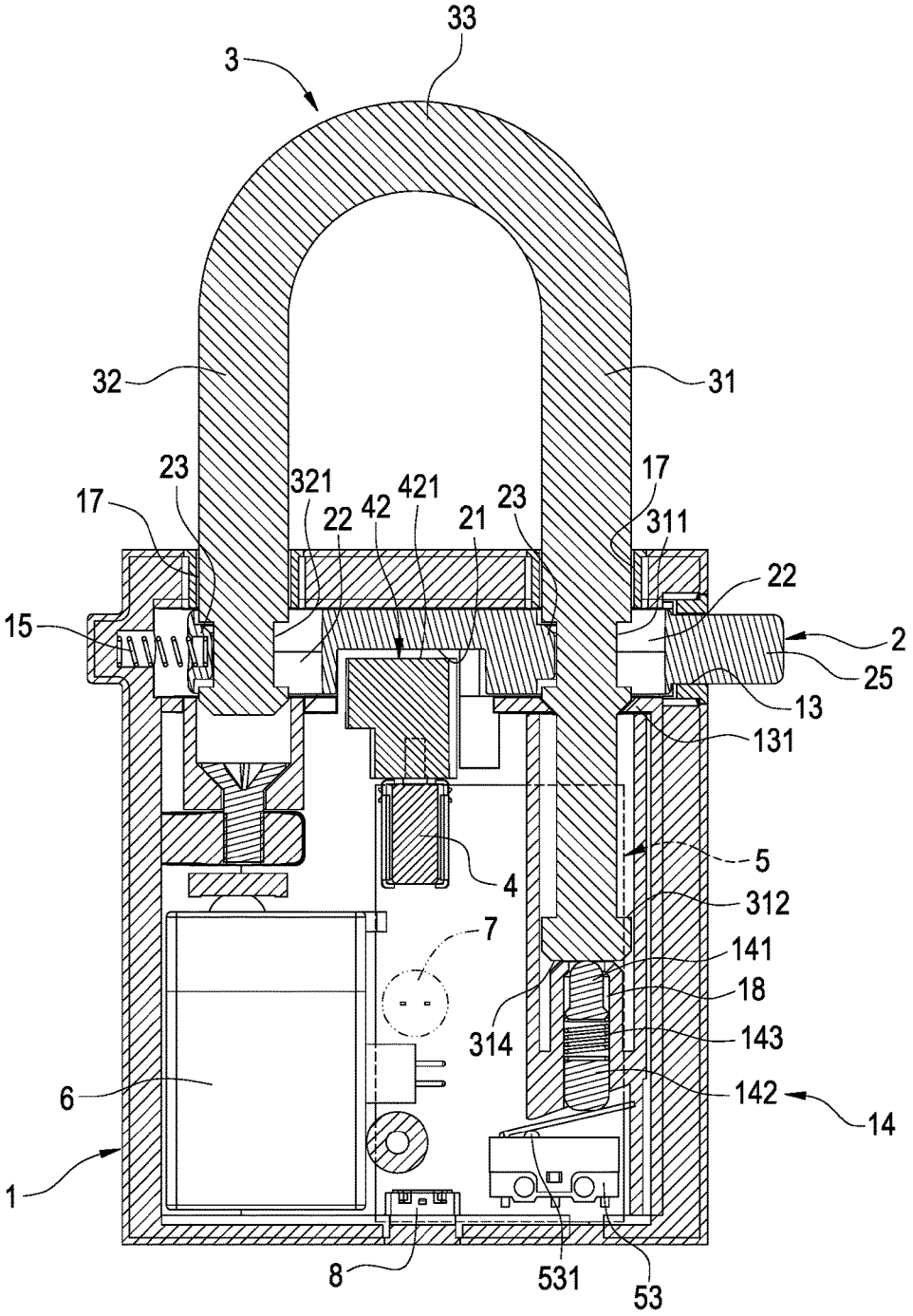
FIG. 4 is a cross-sectional view of FIG. 2 in a locked state.

The shell 1 may be an integral structure (not shown) or a combined structure. As shown in FIG. 1, the shell 1 is a combined structure comprising a first shell 11 and a second shell 12. If the shell 1 is an integral structure, the shell 1 is provided with a transverse groove 13 such that an opening (not labeled, referring to FIG. 1) is formed on one side of the shell 1. Besides, two insertion holes 17 are spaced longitudinally in the shell 1 such that two openings (not labeled, referring to FIG. 1) are formed on the top side of the shell 1. As shown in FIG. 4, each of the two insertion holes 17 penetrates through and communicates with the groove 13.

A first elastic part 15 is disposed at the inner end of the groove 13. One of the insertion holes 17 longitudinally communicates with a guide groove 18 (referring to FIG. 4); a flexible part 14 is disposed in the guide groove 18, sliding longitudinally corresponding to the guide groove 18. The flexile part 14 comprises a second elastic part 143 and two support parts 141, 142 which individually contact two ends of the second elastic part 143. The guide groove 18 has two open ends (not labeled) from which the two support parts 141, 142 individually protrude for contact; the two open ends are individually disposed on the top and the bottom of the guide groove 18, opposite to each other.

The shell 1 further comprises a transparent portion 111 through which the light is allowed to be emitted outward. Preferably, a transparent cover 16 is disposed to cover the transparent portion 111 correspondingly to allow the light to be emitted outward through the transparent cover 16. Specifically, the transparent portion 111 may be disposed on the first shell 11 (referring to FIG. 1) or/and on the second shell 12 (not shown).

The lock bolt 2 can slide back and forth in the groove 13. The lock bolt 2 is provided with two throughholes 22 and a recess 21 disposed between the two throughholes 22. The two throughholes 22 are individually disposed corresponding to the insertion holes 17. The inner wall of each of the two throughholes 22 protrudes radially to form a latch member 23.

The press portion 25 is disposed at the outer end of the lock bolt 2. The first elastic part 15 is flexibly supported between the inner end of the lock bolt 2 and the inner wall of the groove 13 in which a part of the press portion 25 remains protruding out of the outer end of the groove 13 by means of the flexible support of the first elastic part 15, convenient for the press by the user's finger.

The shackle 3 comprises two insertion portions 31, 32 and a curved portion 33 connected between the two insertion portions 31, 32. The shackle 3 is shaped roughly like a letter of "U".

The two insertion portions 31, 32 are not equal in length. The longer one, the insertion portion 31, is inserted into one of the insertion holes 17 and confined in the shell 1. The shorter one, the insertion portion 32, can be inserted into or withdrawn from the other of the insertion holes 17. The two insertion portions 31, 32 are individually provided with the latch portions 311, 321 latched by the latch members 23 correspondingly. The longer insertion portion 31 further has a rod end 314 and a stop portion 312. The stop portion 312 is disposed between the latch portion 311 and the rod end 314.

Two insertion portions 31, 32 of the shackle 3 are individually inserted into the insertion holes 17 of the shell 1 correspondingly and the throughholes 22 of the lock bolt 2 correspondingly such that the latch members 23 individually latch the latch portions 311, 321 correspondingly. The flexible part 14 is flexibly compressed by the press of the rod end 314 of the insertion portion 31 and then is longitudinally and properly shifted. Besides, a longitudinal insertion path (not labeled) is formed by the insertion portion 31 inserted in the shell 1. The guide groove 18 is disposed on and parallel with the insertion path.

The driving unit 4 is disposed in the shell 1 and has a shaft 41. The shaft 41 preferably has an eccentric shape (referring to FIG. 1), which is easier to drive the position limiter 42 to rotate. The position limiter 42 is disposed in the recess 21 of the lock bolt 2. Specifically, the recess 21 has a transverse width. The word "transverse" here means the direction of the lock bolt 2 moving back and forth in the groove 13.

The position limiter 42 has a pair of wide portions 421 with a length roughly equal to the transverse width of the recess 21 and a pair of narrow portions 422 shorter than the pair of the wide portions 421. Preferably, the two wide portions 421 and the two narrow portions 422 are alternatively connected to each other (referring to FIG. 1). In this way, when the driving unit 4 drives the position limiter 42 to rotate, the position limiter 42 will place the wide portions 421 or the narrow portions 422 in the recess 21. When the wide portions 421 are disposed in the recess 21, the lock bolt 2 is restricted by the position limiter 42 and cannot move transversely such that the latch members 23 of the lock bolt 2 can individually latch the latch portions 311, 312 of the shackle 3 correspondingly. Thus, the padlock cannot be unlocked (referring to FIG. 4). When the narrow portions 422 are disposed in the recess 21, a gap is formed between the narrow portions 422 and the recess 21. As a result, the lock bolt 2 is no longer restricted by the position limiter 42 and can move transversely, which causes the latch members 23 of the lock bolt 2 not to latch the latch portions 311, 312 of the shackle 3. Thus, the padlock can be unlocked (referring to FIGS. 5 and 6).

The induction control unit 5 is disposed in the shell 1 and comprises a control circuit 51 and an inductive antenna 52 electrically connected to the control circuit 51. The driving unit 4 is also electrically connected to the control circuit 51 such that the control circuit 51 can control the driving unit 4 to rotate the position limiter 42. The inductive antenna 52 is used to sense the signal emitted from the above-mentioned electronic device (not shown).

The light-emitting component 7 is disposed in the shell 1 and electrically connected to the control circuit 51 such that the control circuit 51 can control the light-emitting component 7 to emit light outward and in particular to emit light outward through the transparent portion 111 or the transparent cover 16. Thus, the current state of the padlock of the present invention, an unlocked state or a locked state, can be indicated. The light-emitting component 7 may be a light-emitting device (LED) and the type of the light-emitting component 7 is not limited by the present invention.

Moreover, the induction control unit 5 further comprises a switch 53 having an actuating member 531. The switch 53 is electrically connected to the control circuit 51 and disposed on the above-mentioned insertion path. Specifically, the switch 53 is located at the lower open end of the guide groove 18 such that the support part 142 can actuate the actuating member 531 of the switch 53 through the lower open end of the guide groove 18. In other words, two ends of the flexible part 14 individually press against the rod end 314 of the shackle 3 and the switch 53.

Therefore, when the two insertion portions 31, 32 of the shackle 3 are pressed back into the shell 1 by the user, the rod end 314 will push the flexible part 14 to actuate the actuating member 531 such that the switch 53 is conducted to generate a control signal. Then, the control circuit 51 controls the driving unit 4 according to the control signal to drive the position limiter 42 to rotate reversely. In this way, the position limiter 42 places the wide portions 421 again in the recess 21 and the locked state of the lock bolt 2 latching the shackle 3 is recovered such that the padlock cannot be unlocked. In other words, the locking by induction performed through the electronic device is not necessary.

The power supply 6 is disposed in the shell 1 and electrically connected to the control circuit 51 to supply power to the driving unit 4, the inductive antenna 52, the switch 53, and the light-emitting component 7. The power supply 6 may be a Lithium-ion battery 61, for example.

The USB connector 8 is electrically connected to the control circuit 51 and is exposed out of the shell 1 for connection of the USB cable to charge the Lithium-ion battery 61.

A stop flange 131 is preferably disposed in one of the two insertion holes 17 of the shell 1, corresponding to and stopping the stop portion 312 of the insertion portion 31, which can prevent the insertion portion 31 inserted into the insertion hole 17 from complete separation. Also, the shackle 3 can rotate around the insertion portion 31.

Figure 5:
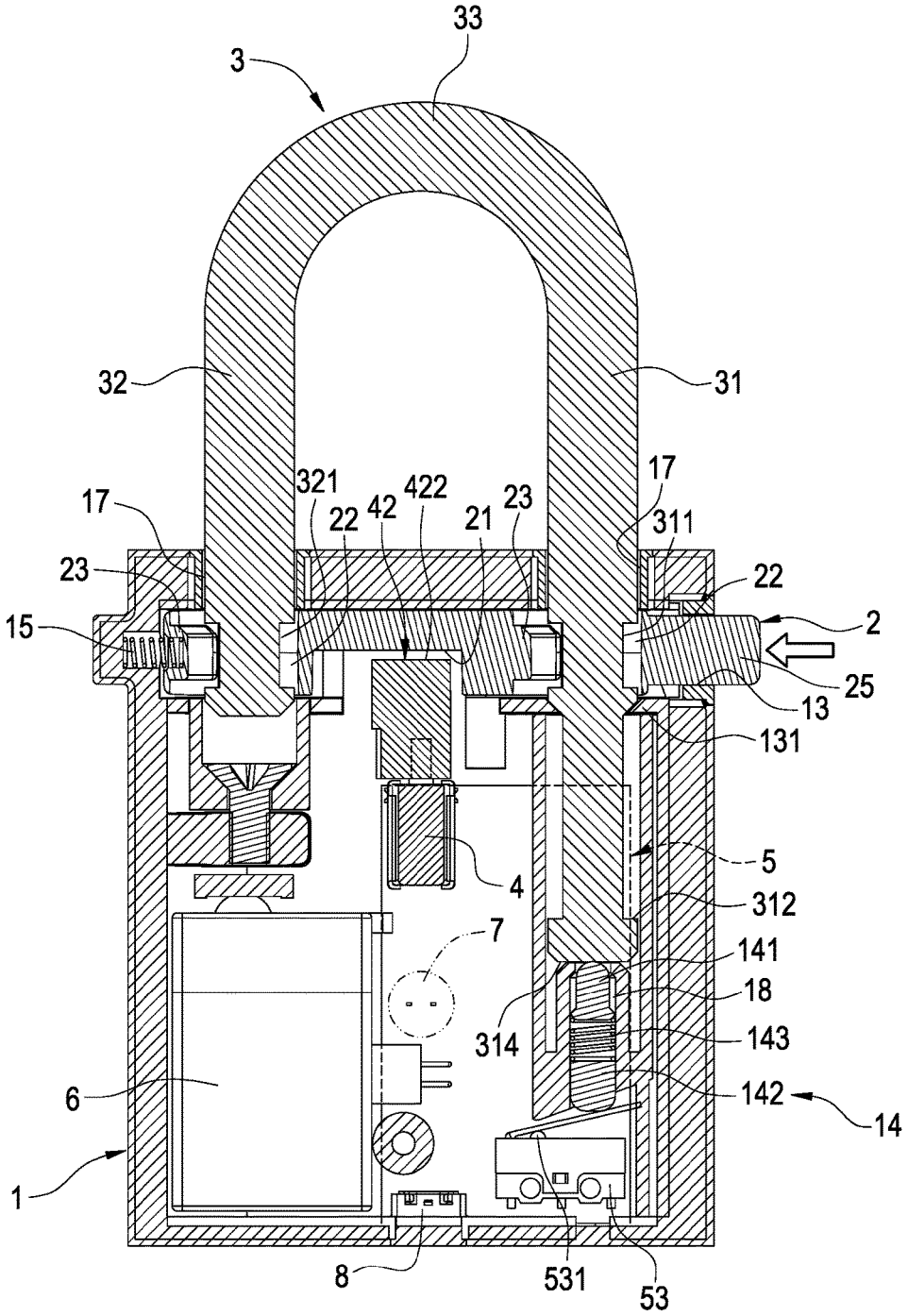
FIG. 5 is a cross-sectional view of the present invention with the position limiter turned an angle.

Please refer to FIGS. 4 and 5. When the padlock is in a locked state as shown in FIG. 4, it will be unlocked by means of the following process. The inductive antenna 52 senses the signal emitted from the above-mentioned electronic device; the induction control unit 5 controls the position limiter 42 to rotate such that the narrow portions 422 are disposed in the recess 21 to let the lock bolt 2 reversely slide back to its original position. At this moment, as long as the user presses the press portion 25 manually, the lock bolt 2 will reversely slide back to its original position and two latch members 23 will move out of the two latch portions 311, 321 to break the latching (referring to FIG. 5).

Figure 6:
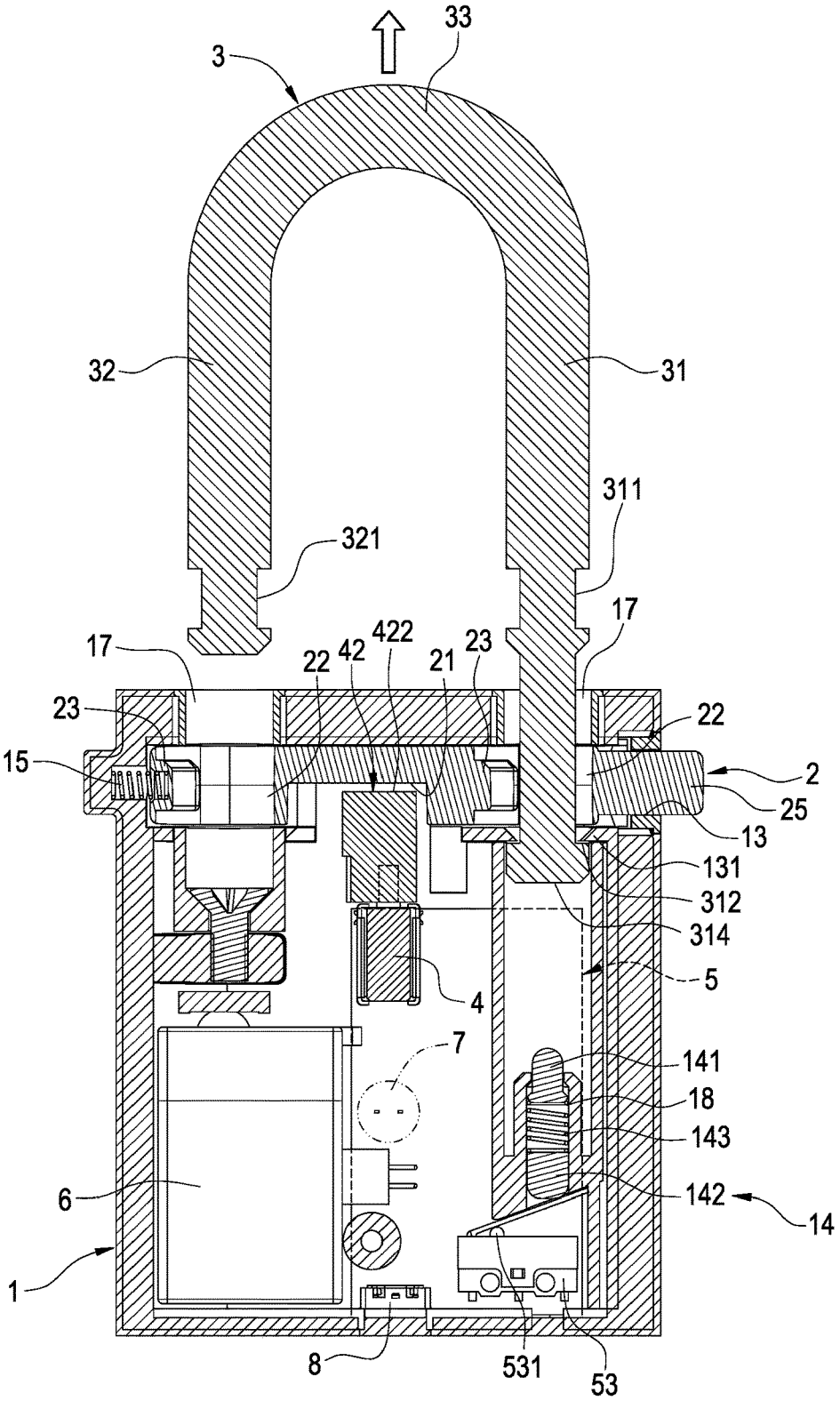
FIG. 6 is a cross-sectional view of the present invention with the lock bolt pressed and the shackle pulled out (in an unlocked state).

Please refer to FIG. 6. Then, by the user pulling the shackle 3 upward or by the spring recovery force of the flexible part 14, the shackle 3 will move upward to release the insertion portion 32 originally inserted into the insertion hole 17. However, the other insertion portion 31 is not released due to the stop portion 312 being stopped by the stop flange 131. Thus, the unlocked state is reached in which the rod end 314 is away from the actuating member 531 of the switch 53.

If the user wants to lock the padlock again, as long as the two insertion portions 31, 32 are pushed into the shell 1 reversely, the rod end 314 will contact the actuating member 531 to turn on the switch 53 (referring to FIG. 5). Further, by means of the control signal generated by the actuated switch 53, the position limiter 42 automatically rotates to place the wide portions 421 again in the recess 21. Meanwhile, the lock bolt 2 is driven to slide transversely such that the two latch members 23 individually latch the latch portions 311, 321 correspondingly. Thus, the padlock returns to the locked state without the induction locking by the electronic device.

Besides, there is no limitation on the numbers of the latch members and latch portions. The numbers can be two or one. For example, only one latch member 23 is disposed corresponding to a single latch portion 311. Alternatively, only one latch member 23 is disposed corresponding to another latch portion 321.

In summary, compared with the prior art, the present invention has the follow effects. Only directly rotating the position limiter 42 to place its narrow portions 422 in the recess 21 of the lock bolt 2 is required to unlock the padlock at the moment of induction, which improves the responses to unlocking and locking and solves the time delay problems of unlocking and locking. Also, the distinguishable lighting indications of unlocking and locking through the light-emitting component 7 are obtained.

Moreover, the present invention further has other effects. It is very convenient to chare the power supply 6 of the padlock of the present invention through the USB connector 8. Two insertion portions 31, 32 of the shackle 3 can be simultaneously latched by the lock bolt 2 to enhance the locking strength and locking stability of the padlock (For a traditional padlock, only one insertion portion is latched). The two insertion portions 31, 32 can slide reversely back into the shell 1 by pressing the shackle 3 to smoothly actuate the switch 53 and further to automatically control the position limiter 42 to rotate reversely. At the same time, the lock bolt 2 is pushed to slide to latch the shackle 3 again to reach the locked state. In this way, the electronic device is no longer required to perform the induction locking; moreover, such an automatic locking can also achieve the effect of instant locking.

The embodiments disclosed in the above description are only preferred embodiments of the present invention, but not to limit the scope of the present invention. The scope of the present invention should be embraced by the accompanying claims and includes all the equivalent modifications and not be limited to the previous description.

What is claimed is:

1. An induction type padlock, which is used to sense a signal to be actuated, comprising:

a shell;

a lock bolt sliding in the shell and provided with a recess, wherein the lock bolt is provided with at least one latch member;

a shackle inserted into the shell through the lock bolt, wherein the shackle is provided with at least one latch portion latched by the latch member correspondingly;

a driving unit disposed in the shell to rotate a position limiter disposed in the recess, wherein the position limiter has at least one wide portion corresponding to the width of the recess and at least one narrow portion shorter than the width of the recess;

a light-emitting component disposed in the shell and emitting light outward thorough the shell; and an induction control unit disposed in the shell and electrically connected to the driving unit and the light-emitting component, wherein the induction control unit senses the signal to control the driving unit to drive the position limiter to select the wide portion or the narrow portion to be disposed in the recess without moving the lock bolt and controls the lighting of the light-emitting component.

2. The induction type padlock according to claim 1, further comprising a power supply disposed in the shell and electrically connected to the induction control unit.

3. The induction type padlock according to claim 1, wherein the shell is provided with a groove in which the lock bolt slides, wherein the lock bolt has a press portion protruding out of the groove.

4. The induction type padlock according to claim 3, wherein the press portion is formed at one end of the lock bolt, wherein a first elastic part is flexibly supported between another end of the lock bolt and an inner wall of the groove.

5. The induction type padlock according to claim 3, wherein the shell is provided with two insertion holes spaced from each other, wherein each of the two insertion holes penetrates through and communicates with the groove, wherein the shackle has two insertion portions which individually insert into the insertion holes correspondingly.

6. The induction type padlock according to claim 5, wherein the number of the latch members and the number of the latch portions are both two, wherein the lock bolt is provided with two throughholes which individually correspond to the insertion holes in which the latch members are individually disposed, wherein each of the insertion portions of the shackle has the latch portion, wherein the latch members of the lock bolt individually latch the latch portions of the shackle correspondingly.

7. The induction type padlock according to claim 5, wherein a stop flange is disposed in the shell corresponding to one of the insertion holes, wherein one of the insertion portions of the shackle is provided with a stop portion corresponding to and stopping the stop flange.

8. The induction type padlock according to claim 1, wherein the induction control unit has a switch disposed on an insertion path formed by the shackle inserting into the shell such that a control signal is generated after the shackle is inserted to actuate the switch, wherein the induction control unit controls the driving unit to rotate the position limiter reversely according to the control signal.

9. The induction type padlock according to claim 8, wherein the shell further comprises a guide groove and a flexible part sliding corresponding to the guide groove, wherein two ends of the flexible part individually press against the switch and one end of the shackle.

10. The induction type padlock according to claim 9, wherein the flexile part comprises a second elastic part and two support parts which individually contacts two ends of the second elastic part, wherein the guide groove has two open ends from which the two support parts individually protrude.

11. The induction type padlock according to claim 1, wherein the at least one wide portion of the position limiter is formed as a pair of wide portions and the at least one narrow portion of the position limiter is formed as a pair of narrow portions, wherein the pairs of the wide portions and the narrow portions are alternately connected to each other.

* * * * *